US007232308B2

(12) United States Patent
Gutmark et al.

(10) Patent No.: US 7,232,308 B2
(45) Date of Patent: Jun. 19, 2007

(54) METHOD AND DEVICE FOR AFFECTING THERMOACOUSTIC OSCILLATIONS IN COMBUSTION SYSTEMS

(75) Inventors: Ephraim Gutmark, Cincinnati, OH (US); Christian Oliver Paschereit, Berlin (DE)

(73) Assignee: ALSTOM Technology Ltd., Baden (CH)

( * ) Notice: Subject to any disclaimer, the term of this patent is extended or adjusted under 35 U.S.C. 154(b) by 0 days.

(21) Appl. No.: 10/725,563

(22) Filed: Dec. 3, 2003
(Under 37 CFR 1.47)

(65) Prior Publication Data

US 2005/0016180 A1 Jan. 27, 2005

(30) Foreign Application Priority Data

Dec. 7, 2002 (DE) ..... 102 57 244

(51) Int. Cl.
*F23N 5/26* (2006.01)
*F23D 21/00* (2006.01)

(52) U.S. Cl. ..... 431/114; 431/12; 60/725

(58) Field of Classification Search ..... 431/114, 431/1, 2, 12, 75; 60/725, 734; 381/71.1, 381/71.2, 71.14; 700/274
See application file for complete search history.

(56) References Cited

U.S. PATENT DOCUMENTS 4,490,841 A * 12/1984 Chaplin et al. ..... 381/71.14
4,909,731 A * 3/1990 Zinn et al. ..... 431/1
5,719,791 A 2/1998 Neumeier et al. ..... 700/274
6,170,265 B1 * 1/2001 Polifke et al. ..... 60/725
6,202,401 B1 * 3/2001 Seume et al. ..... 431/114
6,430,933 B1 * 8/2002 Keller ..... 60/725
6,464,489 B1 10/2002 Gutmark et al. ..... 431/114
2001/0027638 A1 * 10/2001 Paschereit et al. ..... 60/725

FOREIGN PATENT DOCUMENTS

| | | |
|---|---|---|
| EP | 0 602 942 | 6/1994 |
| EP | 0 918 152 | 5/1999 |
| EP | 0 918 152 A1 | 5/1999 |
| EP | 0 918 153 | 5/1999 |
| EP | 0 985 810 | 3/2000 |
| EP | 0 985 810 A1 | 3/2000 |
| EP | 1 182 399 | 2/2002 |
| GB | 2 088 951 A * | 6/1982 |

OTHER PUBLICATIONS

Search Report for European Appl. No. 03104405.0 (Mar. 11, 2005).
Search Report for German Appl. No. 102 57 244.5 (Mar. 17, 2005).

* cited by examiner

*Primary Examiner*—Josiah C. Cocks
(74) *Attorney, Agent, or Firm*—Cermak & Kenealy, LLP; Adam J. Cermak

(57) ABSTRACT

The present invention relates to a method and a device (1) for affecting thermoacoustic oscillations in a combustion system (6) comprising at least one burner (7) and at least one combustor (8).

In order to improve the action of affecting the thermoacoustic oscillations, a gas flow forming in the e region of the burner (7) is excited acoustically, modulated injection of fuel is carried out, the acoustic excitation of the gas flow and the modulated injection of the fuel are coordinated in order to affect the same interference frequency.

9 Claims, 1 Drawing Sheet

METHOD AND DEVICE FOR AFFECTING THERMOACOUSTIC OSCILLATIONS IN COMBUSTION SYSTEMS

TECHNICAL FIELD

The invention relates to a method and a device for affecting thermoacoustic oscillations in a combustion system having at least one burner and at least one combustor.

PRIOR ART

It is known that undesired thermoacoustic oscillations frequently occur in combustors of gas turbines. The term "thermoacoustic oscillations" designates mutually self-reinforcing thermal and acoustic disruptions. In the process, high oscillation amplitudes can occur, which can lead to undesired effects, such as high mechanical loading of the combustor and increased $NO_x$ emissions as a result of inhomogeneous combustion. This applies in particular to combustion systems with little acoustic damping. In order to ensure a high output in relation to the pulsations and emissions over a wide operating range, active control of the combustion oscillations may be necessary.

In order to achieve low $NO_x$ emissions, in modern gas turbines an increasing proportion of the air is led through the burner itself and the cooling air stream is reduced. Since, in conventional combustors, the cooling air flowing into the combustor has a sound-dampening effect and therefore contributes to the dampening of thermoacoustic oscillations, the sound damping is reduced by the aforementioned measures for reducing the $NO_x$ emissions.

EP 0 918 152 A1 discloses affecting thermoacoustic oscillations by the shear layer forming in the region of the burner being excited acoustically.

EP 0 985 810 A1 discloses the fact that thermoacoustic oscillations can be affected by modulated injection of liquid or gaseous fuel being carried out.

The known devices and methods are in each case coordinated to affect a specific interference frequency of the thermoacoustic oscillations. There is a further demand to reduce the disruptive effect of the thermoacoustic oscillation systems to a still greater extent.

SUMMARY OF THE INVENTION

This is the starting point for the invention. The present invention concerns the problem of indicating a way of improving the action of affecting thermoacoustic oscillations in a combustion system.

The invention is based on the general idea of combining the fundamentally known acoustic excitation of the gas flow and the fundamentally known modulated injection of the fuel with each other in order to affect the same interference frequency of the thermoacoustic oscillations. Trials have shown that the combination proposed by the invention has a surprisingly high suppression action or damping action for the respective interference frequency, which goes considerably beyond the damping action of the known acoustic gas flow excitation on its own and beyond the damping action of the known modulated fuel injection on its own, and beyond the damping action expected for a combination of these two affecting methods. The unexpectedly great improvement in the damping action is in this case traced back to synergistic effects which surprisingly occur but have not yet been explained.

In accordance with an advantageous development, the instantaneous acoustic gas flow excitation and the instantaneous modulated fuel injection can be phase-coupled with the same signal measured in the combustion system and correlating with the thermoacoustic oscillations. This achieves the situation where the two affecting methods do not operate independently of each other but interact in a phase-coupled manner.

In this case, the phases relate to the amplitude profile of the interference frequency within the thermoacoustic oscillations which is preferably to be affected.

The aforesaid measured signal is subjected to a first phase shift in order to implement the acoustic gas flow excitation, while it is subjected to a second phase shift in order to implement the modulated fuel injection. In this case, it may be expedient to give the first phase shift a value different from that of the second phase shift. By means of the separate setting of the phase shifts, the synergistic interactions of the two combined affecting methods can be optimized in order to improve the damping action.

Further important features and advantages of the invention emerge from drawings and from the associated figure description using the drawings.

BRIEF DESCRIPTION OF THE DRAWINGS

A preferred exemplary embodiment of the invention is illustrated in the drawing and will be explained in more detail in the following description.

The single

WAYS OF IMPLEMENTING THE INVENTION

Figure 1:
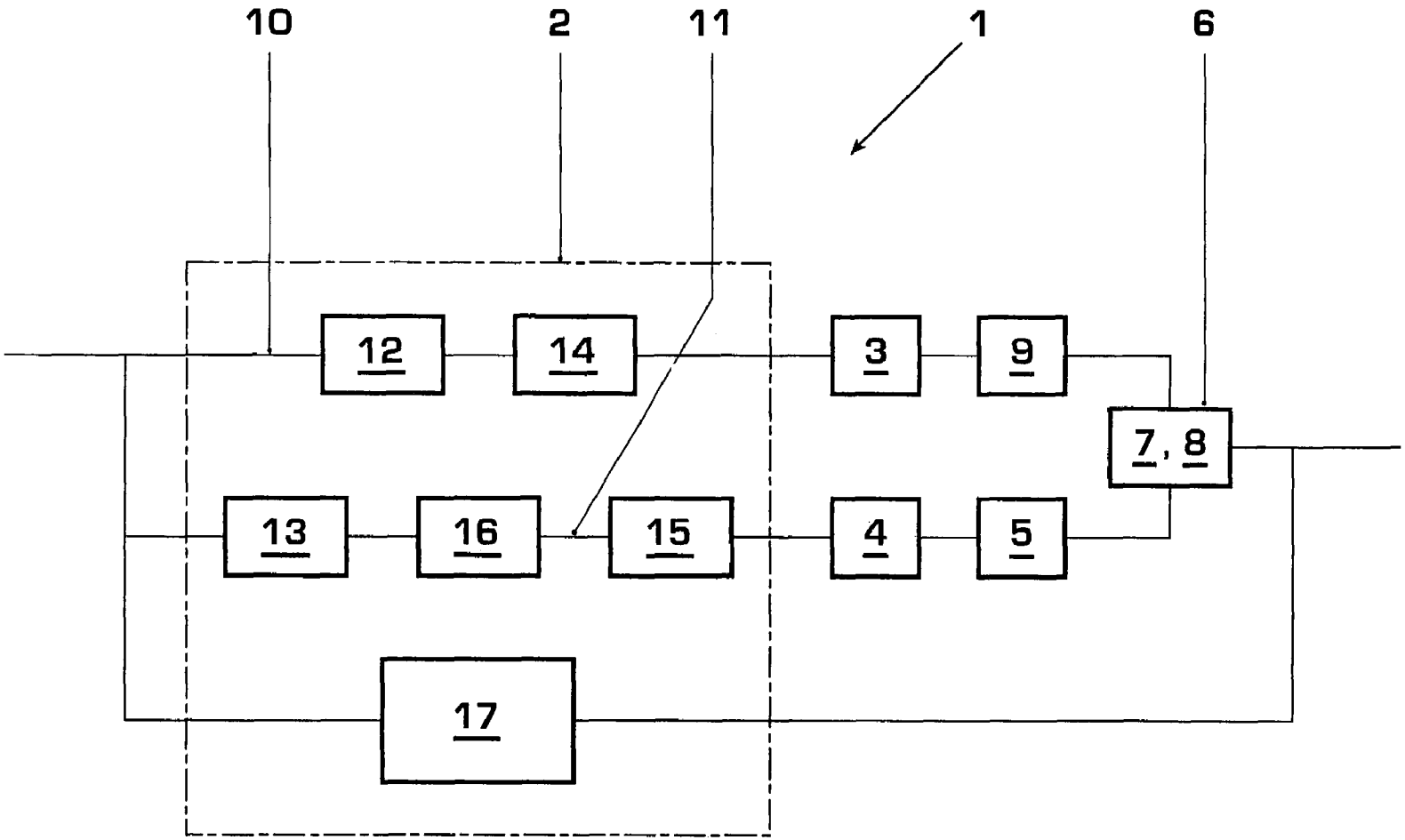
FIG. 1 shows a highly simplified basic illustration of a device according to the invention.

According to FIG. 1, a device 1 according to the invention comprises a control system 2, which is merely symbolized here by a frame represented by broken lines. The device 1 additionally has at least one acoustic source 3 and at least one control valve 4 of a fuel supply device 5. The fuel supply device 5 is coupled to a combustion system 6, which normally has at least one burner 7 and at least one combustion chamber 8. For the purpose of simplification, burner 7 and combustion chamber 8 are symbolized by a common rectangle here. In addition, a gas supply device 9 is assigned to the combustion system 6. While the control valve 4 can be used to control the quantity of liquid or gaseous fuel supplied to the combustion system 6, the acoustic source 3 can be used to affect a gas flow forming in the combustion system 6. In this case, the acoustic source 3—as here—can act directly on the combustion system 6 or indirectly via the gas supply device 9.

The device 1 is associated with the combustion system 6, and is used to affect thermoacoustic oscillations which can occur in the combustion system 6. For this purpose, the control system 2 contains a first control path 10 and a second control path 11 which, on the input side, contain a first time delay element 12 and a second time delay element 13, respectively. Furthermore, on the output side, the control paths 10, 11 contain a first amplifier 14 and a second amplifier 15, respectively. In addition, the second control, path 11 contains a high-pass filter 16 between the second time delay element 13 and second amplifier 15. While the first control path 10 is connected on the output side to the acoustic source 3, the second control path 11 is connected on the output side to the control valve 4.

Furthermore, the control system 2 contains a control algorithm 17 which, on the basis of incoming signals, outputs appropriate signals to the input sides of the control paths 10, 11 which, to this extent, are connected in parallel. The control algorithm 17 receives its input signals from sensors, not shown here, which are designed to measure thermoacoustic oscillations in the combustion system 6. The signals determined by these sensors in this case correlate with the thermoacoustic oscillations in the combustion system 6. The measured signals can be pressure signals in this case, the sensors then comprising pressure sensors, preferably microphones, in particular water-cooled microphones and/or microphones with piezoelectric pressure transducers. It is likewise possible for the signals measured by the sensors to be formed by chemiluminescence signals, preferably by chemiluminescence signals from the emission of one of the radicals OH or CH. The sensors can then expediently have optical sensors for visible or infrared radiation, in particular optical fiber probes.

The pressure or luminescence signal measured in the combustor 8, for example, is conditioned appropriately by the control algorithm 17 and is supplied in parallel to the time delay elements 12, 13. The phase shifts of the incoming signal envisaged for the respective control path 10, 11 are then carried out in the time delay elements 12, 13. In the second control path 11, the high-pass filter 16 holds back undesired, low-frequency interference, so that only the desired, high-frequency, phase-shifted signals pass into the second amplifier 15. Signal amplification is then carried out with the aid of the amplifiers 14, 15. The phase shifts achieved by the time delay elements 12, 13 are preferably selected to be of different magnitudes. In particular, an embodiment is possible in which the control system 2 can set the phase shifts of the time delay elements 12, 13 independently of each other, in particular via its control algorithm 17. Furthermore, provision can be made for the control system 2 to drive the amplifiers 14, 15 independently of each other, for example via the control algorithm 17, in order to generate different signal amplitudes. In a corresponding way, the high-pass filter 16 can also be configured to be adjustable.

With the aid of the amplifiers 14, 15, driver signals are generated on the output side of the control paths 10, 11, and can be used to drive or actuate the acoustic source 3 or the control valve 4. In this way, the desired action of affecting the thermoacoustic oscillations in the combustion system 6 can be achieved.

The control system 2, in particular its control algorithm 17, can actuate the time delay elements 12, 13 and/or the amplifiers 14, 15 and/or the high-pass filter 16 as a function of the instantaneous pressure or luminescence signals. In this way, the influence of the respective control path 10, 11 on the interference frequency to be damped can be varied or tracked. To this extent, the result is closed control loops for both control paths 10, 11.

For the functioning of affecting the thermoacoustic oscillations by means of acoustic excitation of the gas flow, reference is made to EP 0 918 152 A1, whose content is hereby incorporated in the disclosure content of the present invention by express reference.

In a corresponding way, for the functioning of affecting the thermoacoustic oscillations by means of modulated fuel injection, reference is made to EP 0 985 810 A1, whose content is hereby incorporated in the disclosure content of the present invention by express reference.

The mechanical fluidic stability of a gas turbine burner is of critical importance for the occurrence of thermoacoustic oscillations. The mechanical fluidic instability waves arising in the burner lead to the formation of vortices. These vortices, also referred to as coherent structures, play an important role in mixing processes between air and fuel. The spatial and temporal dynamics of these coherent structures affect the combustion and the liberation of heat. As a result of the acoustic excitation of the gas flow, the formation of these coherent structures can be counteracted. If the production of vortex structures at the burner outlet is reduced or prevented, then the periodic fluctuation in the liberation of heat is also reduced thereby. These periodic fluctuations in the liberation of heat form the basis for the occurrence of thermoacoustic oscillations, however, so that, by means of the acoustic excitation, the amplitude of the thermoacoustic oscillations can be reduced.

It is of particular advantage in this case if, in order to affect the thermoacoustic oscillations, a shear layer forming in the region of the burner is excited acoustically. Here, shear layer designates the mixing layer which forms between two fluid flows of different velocities. Affecting the shear layer has the advantage that excitations introduced into the shear layer are amplified. Thus, only a little excitation energy is needed in order to extinguish an existing sound field. As distinct from this, in the case of a pure anti-sound principle, an existing sound field is extinguished by means of a phase-shifted sound field of the same energy.

The shear layer can be excited both downstream and upstream of the burner. Downstream of the burner, the shear layer can be excited directly. In the case of excitation upstream of the burner, the acoustic excitation is initially introduced into a working gas, for example air, the excitation then being transmitted through the burner into the shear layer after passing through the working gas. Since only low excitation powers are necessary, the acoustic source 3 can be formed by acoustic drivers, for example one or more loudspeakers, which are aimed at the gas flow. Alternatively, one or more chamber walls can be excited mechanically to oscillate at the respectively desired frequency.

The instantaneous acoustic excitation of the gas flow or its shear layer is preferably phase-coupled with a signal which is measured in the combustion system and which is correlated with the thermoacoustic fluctuations. This signal can be measured downstream of the burner in the combustor or in a quietening chamber arranged upstream of the burner. The instantaneous acoustic excitation is then controlled as a function of this measured signal.

By selecting a suitable phase difference, which differs depending on the type of measured signal, between the measured signal and instantaneous acoustic excitation signal, the acoustic excitation counteracts the formation of coherent structures, so that the amplitude of the pressure pulsation is reduced. The aforementioned phase difference is set by the time delay element 12 and takes account of the fact that phase shifts generally occur as a result of the arrangement of the measuring sensors and acoustic drivers or sources 3 and as a result of the measuring instruments and lines themselves. If the set relative phase is selected such that the result is the greatest possible reduction in the pressure amplitude, all these phase-rotating effects are implicitly taken into account. Since the most beneficial relative phase can change over time, the relative phase advantageously remains variable and can be tracked, for example via monitoring the pressure fluctuations, so that high suppression is always ensured.

With the aid of modulated fuel injection, the formation of thermoacoustic oscillations can likewise be affected. In this case, modulated fuel injection is understood to mean any time-varying injection of liquid or gaseous fuel. This modulation can be carried out, for example, at any desired frequency. The injection can be carried out independently of the phase of the pressure oscillations in the combustion system; however, the embodiment shown here is preferred, in which the injection is phase-coupled to a signal which is measured in the combustion system 6 and is correlated with the thermoacoustic oscillations. The modulation of the fuel injection is carried out by means of appropriate opening and closing of the control valve(s) 4, by which means the injection times (start and end of the injection) and/or the quantity injected are varied. As a result of the modulated fuel supply, the quantity of fuel converted into large-volume vortices can be controlled. In this way, the formation of the coherent liberation of heat and thus the production of thermoacoustic instabilities can be affected.

In the arrangement selected here, the acoustic excitation of the gas flow is carried out upstream of the modulated injection of the fuel. This arrangement can be of particular advantage and can intensify the interaction of the two different affecting methods.

The modulated injection of the fuel is preferably carried out in the shear layer, already mentioned above, within the burner 7. In this case, it may be sufficient to modulate only a relatively small proportion of the injected quantity of fuel. In particular, it may be expedient to inject in a modulated manner less than 20% of the quantity of fuel injected in total.

Via the control algorithm 17, it may be possible in particular to vary the interference frequency of the thermoacoustic oscillations to be affected with the aid of the device 1 according to the invention. For example, the main interference frequency may depend on the respective operating state of the combustion system 6.

LIST OF REFERENCES

1 device
2 control system
3 acoustic source
4 control valve
5 fuel supply device
6 combustion system
7 burner
8 combustor
9 gas supply device
10 first control path
11 second control path
12 first time delay element
13 second time delay element
14 first amplifier
15 second amplifier
16 high-pass filter
17 control algorithm

What is claimed is:

1. A method for affecting thermoacoustic oscillations in a combustion system having at least one burner and at least one combustor, the method comprising:

measuring a signal correlating with the thermoacoustic oscillations in the combustion system;

subjecting the measured signal to a first phase shift;

generating a first driver signal for driving at least one acoustic source to produce an instantaneous acoustic excitation of the gas flow;

subjecting the measured signal to a second phase shift;

generating a second driver signal for driving at least one control valve to produce an instantaneous modulated injection of the fuel;

acoustically exciting a gas flow forming in the region of the burner with said at least one acoustic source based on said first driver signal;

modulating injection of fuel with said at least one control valve based on said second driver signal; and coordinating the acoustic excitation of the gas flow and the modulated injection of the fuel to affect the same interference frequency of the thermoacoustic oscillations;

wherein the instantaneous acoustic excitation of the gas flow and the instantaneous modulated injection of the fuel are phase-coupled with said signal correlating with the thermoacoustic oscillations in the combustion system.

2. The method as claimed in claim 1, wherein the first phase shift has a value different from that of the second phase shift.

3. The method as claimed in claim 1, wherein the acoustic excitation of the gas flow is performed upstream of the modulated injection of the fuel.

4. The method as claimed in claim 1, wherein the modulated injection of the fuel is performed in a shear layer forming in the gas flow.

5. The method as claimed in claim 4, wherein the modulated injection of the fuel is performed with less than the total quantity of fuel injected.

6. The method as claimed in claim 4, wherein the modulated injection of the fuel is performed with less than 20% of the total quantity of fuel injected.

7. A device for affecting thermoacoustic oscillations in a combustion system comprising:

at least one burner and at least one combustor;

at least one acoustic source configured and arranged for producing acoustic excitation of a gas flow forming in the region of the burner;

the burner having at least one fuel supply device with at least one control valve for producing modulated injection of the fuel;

a control system which drives the at least one acoustic source and the at least one control valve to affect the same interference frequency of the thermoacoustic oscillations;

wherein the control system comprises an input side, an output side, a first control path for the acoustic excitation of the gas flow, and a second control path for the modulated injection of the fuel;

wherein the same signal correlating with the thermoacoustic oscillations is supplied to both the first and second control paths on the input side and in parallel;

wherein the two control paths each contain a time delay element for producing a phase shift;

wherein on the output side, the first control path conducts a first driver signal to the acoustic source; and wherein on the output side, the second control path conducts a second driver signal to the control valve.

8. The device as claimed in claim 7, wherein the first time delay element produces a phase shift different from that of the second time delay element.

9. The device as claimed in claim 7 wherein the at least one acoustic source is arranged upstream of a point at which the modulated injection of the fuel is performed.

* * * * *